US010037727B2

(12) United States Patent
Jin

(10) Patent No.: US 10,037,727 B2
(45) **Date of Patent: *Jul. 31, 2018**

(54) METHOD OF RGBW COMPENSATION BASED ON COLOR ABERRATIONS OF WHITE SUBPIXELS AND APPARATUS THEREOF

(71) Applicant: Shenzhen China Star Optoelectronics Technology Co., Ltd., Shenzhen, Guangdong (CN)

(72) Inventor: Yufeng Jin, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/711,147

(22) Filed: Sep. 21, 2017

(65) Prior Publication Data

US 2018/0012532 A1 Jan. 11, 2018

Related U.S. Application Data

(63) Continuation of application No. 14/898,275, filed on Dec. 14, 2015, now Pat. No. 9,858,846.

(51) Int. Cl.

| | |
|---|---|
| ***G09G 5/02*** | (2006.01) |
| ***G09G 3/20*** | (2006.01) |
| ***G09G 3/3208*** | (2016.01) |

(52) U.S. Cl.

CPC ..... *G09G 3/2003* (2013.01); *G09G 3/3208* (2013.01); *G09G 2300/0452* (2013.01); *G09G 2320/0666* (2013.01); *G09G 2320/0693* (2013.01); *G09G 2360/16* (2013.01)

(58) Field of Classification Search

None

See application file for complete search history.

(56) References Cited

U.S. PATENT DOCUMENTS

2016/0293082 A1* 10/2016 Zhang ..... G09G 3/2003

* cited by examiner

*Primary Examiner* — Phi Hoang
*Assistant Examiner* — Mohammad H Akhavannik
(74) *Attorney, Agent, or Firm* — Andrew C. Cheng

(57) ABSTRACT

Disclosed is a method of RGBW compensation based on color aberrations of white subpixel and an apparatus thereof: when aberrations exist between a color coordinate point Ws of white subpixel and a standard white color coordinate point Wd under sRGB, analyzing color coordinates of every subpixel on the RGBW panel, and then dividing a triangle with vertices points Rs, Gs and Bs into three triangle regions based on Ws as the center point; based on ranges of the three triangle regions, a triangle region where Wd is located is confirmed; a first data is calibrated by performing compensating the white subpixel corresponding by the center point Ws via a predetermined normalized proportion through two subpixels corresponding to the other two points within the triangle region surrounding and locating Wd. Through the aforementioned manner, the present invention is capable of calibrating aberrations of white subpixels in order to normalize images of RGBW panels.

6 Claims, 4 Drawing Sheets

METHOD OF RGBW COMPENSATION BASED ON COLOR ABERRATIONS OF WHITE SUBPIXELS AND APPARATUS THEREOF

CROSS REFERENCE TO RELATED APPLICATIONS

This is a continuation application of co-pending patent application Ser. No. 14/898,275, filed on Dec. 14, 2015, which is a national stage of PCT Application Number PCT/CN2015/090138, filed on Sep. 21, 2015, claiming foreign priority of Chinese Patent Application Number 201510593712.3, filed on Sep. 17, 2015.

TECHNICAL FIELD

The present invention relates to a display technology field, and particularly to a method of RGBW compensation based on color aberrations of white subpixels and an apparatus thereof.

BACKGROUND

With strengthening of people's awareness of energy conservation, energy consumptions of products gradually turn into an important factor of product. Under a motivation of awareness of energy conservation, developments of RGBW come afterwards. LG Display added white subpixel based on RGB foundation inventively to form RGBW 4K. Light transmittance of panels of RGBW 4K is increasing apparently with participation of white subpixel, and luminance of panel increases 1.5 times based on the foundation of panels of traditional RGB 4K.

Nowadays, a variety of algorithms exists in switching from RGB signals to RGBW signals, and comprises traditional algorithms and new algorithms in research. However, after applying those algorithms to switch RGB signals into RGBW signals particularly in Organic Light Emitting Display (OLED), aberrations are found between color coordinate points of actual white subpixels (W-subpixel) and standard white color coordinate points under sRGB; the white subpixels have larger color aberrations.

DISCLOSURE OF INVENTION

A technical problem mainly solved in the present invention is to provide a method of RGBW compensation based on color aberrations of white subpixel and an apparatus thereof in order to normalize images of RGBW panels and be capable of calibrating aberrations of white subpixels.

To solve the aforementioned technical problem, a technical solution applied in the present invention is: a method of RGBW compensation is provided based on color aberrations of white subpixels, aberrations exist between a color coordinate point Ws of white subpixels of image pixels on a RGBW panel and a standard white color coordinate point Wd under sRGB before compensating, and the method comprises: inserting the image pixels based on a first data of RGBW color space; analyzing color coordinates of every subpixel of the image pixels on the RGBW panel, and then dividing a triangle RsGsBs with vertices color coordinate points Rs, Gs, and Bs of red subpixel, green subpixel and green pixel of the image points into three triangle regions, RsGsWs, RsBsWs, and BsGsWs, based on taking the color coordinate point Ws as the center point; confirming a triangle region where the color coordinate point is located based on ranges of the three triangle regions, RsGsWs, RsBsWs, and BsGsWs; performing compensating the white subpixel corresponding by the center point Ws via a predetermined normalized proportion to calibrated the first data through two subpixels corresponding to the other two color coordinate points, except the center point Ws, within the triangle region surrounding and locating the color coordinate point Wd; exporting the post-compensated a second data of image pixels based on the RGBW color space;

wherein steps of performing compensating the white subpixel corresponding by the center point Ws via a predetermined normalized proportion through two subpixels corresponding to the other two color coordinate points, except the center point Ws, within the triangle region surrounding and locating the color coordinate point comprises: if the color coordinate point Wd is located within the triangle region BsGsWs, a normalized proportion calculating a luminance among subpixel, the blue subpixel, green subpixel and white subpixel, is BsY, GsY, and WsY, and BsY+GsY+WsY=1; performing calibration process to the first data by applying the normalized proportion BsY, GsY, and WsY to obtain a second data of image pixels based on the RGBW color space, $$R_{fo}(i)=R_o(i)$$

$$G_{fo}(i)=G_o(i)+W_o(i)*G_sY(i),$$

$$B_{fo}(i)=B_o(i)+W_o(i)*B_sY(i)$$

$$W_{fo}(i)=W_o(i)*W_sY(i)$$

wherein Ro(i), Go(i), Bo(i), and Wo(i) are first data of a pixel point i; Rfo(i), Gfo(i), Bfo(i), and Wfo(i) are second data of the pixel point i, BsY(i), GsY(i), and WsY(i) is a normalized proportion of a luminance among a blue subpixel, green subpixel and white subpixel of the pixel point i;

if the color coordinate point Wd is located within the triangle region BsRsWs, a normalized proportion calculating a luminance among the blue subpixel, red subpixel and white subpixel is BsY, RsY, and WsY, and BsY+RsY+WsY=1;

performing calibration process to the first data by applying the normalized proportion BsY, RsY, and WsY to obtain second data of image pixels based on the RGBW color space, $$R_{fo}(j)=R_o(j)+W_o(j)*R_sY(j)$$

$$G_{fo}(j)=G_o(j),$$

$$B_{fo}(j)=B_o(j)+W_o(j)*B_sY(j)$$

$$W_{fo}(j)=W_o(j)*W_sY(j)$$

wherein Ro(j), Go(j), Bo(j), and Wo(j) are first data of a pixel point j, Rfo(j), Gfo(j), Bfo(j), and Wfo(j) are second data of the pixel point j, BsY(j), RsY(j), and WsY(j) is a normalized proportion of a luminance among a blue subpixel, red subpixel and white subpixel of the pixel point j;

if the color coordinate point Wd is located within the triangle region RsGsWs, a normalized proportion calculating a luminance among the red subpixel, green subpixel and white subpixel is RsY, GsY, and WsY, and RsY+GsY+WsY=1;

performing calibration process to the first data by applying the normalized proportion RsY, GsY, and WsY to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k),$$

$$B_{fo}(k)=B_o(k)$$

$$W_{fo}(k)=W_o(k)*W_sY(k)$$

wherein Ro(k), Go(k), Bo(k), and Wo(k) are first data of a pixel point k, Rfo(k), Gfo(k), Bfo(k), and Wfo(k) are second data of the pixel point k, RsY(k), GsY(k), and WsY(k) is a normalized proportion of a luminance among a red subpixel, green subpixel and white subpixel of the pixel point k.

The normalized proportion BsY, GsY, and WsY is obtained according to formula 1, which is:

$$W_sY=\frac{\begin{array}{c}B_sx*G_sy*W_sy-B_sy*G_sx*W_sy-B_sx*W_sy*W_dy+\\B_sy*W_sy*W_dx+G_sx*W_sy*W_dy-G_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$G_sY=\frac{\begin{array}{c}B_sx*G_sy*W_sy-B_sy*G_sy*W_sx-B_sx*G_sy*W_dy+\\B_sy*G_sy*W_dx+G_sy*W_sx*W_dy-G_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$B_sY=\frac{\begin{array}{c}B_sy*G_sx*W_sy-B_sy*G_sy*W_sx-B_sy*G_sx*W_dy+\\B_sy*G_sy*W_dx+B_sy*W_sx*W_dy-B_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

The normalized proportion BsY, RsY, and WsY is obtained according to formula 2, which is:

$$W_sY=\frac{\begin{array}{c}B_sx*R_sy*W_sy-B_sy*R_sx*W_sy-B_sx*W_sy*W_dy+\\B_sy*W_sy*W_dx+R_sx*W_sy*W_dy-R_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+G_sx*W_sy*W_dy-R_sy*W_sx*W_dy\end{array}}$$

$$R_sY=\frac{\begin{array}{c}B_sx*R_sy*W_sy-B_sy*R_sy*W_sx-B_sx*R_sy*W_dy+\\B_sy*R_sy*W_dx+R_sy*W_sx*W_dy-R_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}}$$

$$B_sY=\frac{\begin{array}{c}B_sy*R_sx*W_sy-B_sy*R_sy*W_sx-B_sy*R_sx*W_dy+\\B_sy*R_sy*W_dx+B_sy*W_sx*W_dy-B_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

The normalized proportion RsY, GsY, and WsY is obtained according to formula 3, which is:

$$W_sY=\frac{\begin{array}{c}R_sx*G_sy*W_sy-R_sy*G_sx*W_sy-R_sx*W_sy*W_dy+\\R_sy*W_sy*W_dx+G_sx*W_sy*W_dy-G_sy*W_sy*W_dx\end{array}}{\begin{array}{c}R_sx*G_sy*W_dy-R_sy*G_sx*W_dy-R_sx*W_sy*W_dy+\\R_sy*W_sx*W_dy+G_sx*W_sy*W_dy-G_sy*W_sx*W_dy\end{array}}$$

$$G_sY=\frac{\begin{array}{c}R_sx*G_sy*W_sy-R_sy*G_sy*W_sx-R_sx*G_sy*W_dy+\\R_sy*G_sy*W_dx+G_sy*W_sx*W_dy-G_sy*W_sy*W_dx\end{array}}{\begin{array}{c}R_sx*G_sy*W_dy-R_sy*G_sx*W_dy-R_sx*W_sy*W_dy+\\R_sy*W_sx*W_dy+G_sx*W_sy*W_dy-G_sy*W_sx*W_dy\end{array}}$$

$$R_sY=\frac{\begin{array}{c}R_sy*G_sx*W_sy-R_sy*G_sy*W_sx-R_sy*G_sx*W_dy+\\R_sy*G_sy*W_dx+R_sy*W_sx*W_dy-R_sy*W_sy*W_dx\end{array}}{\begin{array}{c}R_sx*G_sy*W_dy-R_sy*G_sx*W_dy-R_sx*W_sy*W_dy+\\R_sy*W_sx*W_dy+G_sx*W_sy*W_dy-G_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

To solve the aforementioned technical problem, another technical solution applied in the present invention is: providing a method of RGBW compensation based on color aberrations of white subpixel, wherein aberrations exist between a color coordinate point Ws of white subpixel of image pixels on a RGBW panel and a standard white color coordinate point Wd under sRGB before compensating, and the method comprises: inserting the image pixels based on a first data of RGBW color space; analyzing color coordinates of every subpixel of the image pixels on the RGBW panel, and then dividing a triangle RsGsBs with vertices color coordinate points Rs, Gs, and Bs of red subpixel, green subpixel and green pixel of the image points into three triangle regions, RsGsWs, RsBsWs, and BsGsWs, based on taking the color coordinate point Ws as the center point; confirming a triangle region where the color coordinate point is located based on ranges of the three triangle regions, RsGsWs, RsBsWs, and BsGsWs; performing compensating the white subpixel corresponding by the center point Ws via a predetermined normalized proportion to calibrated the first data through two subpixels corresponding to the other two color coordinate points, except the center point Ws, within the triangle region surrounding and locating the color coordinate point Wd; exporting the post-compensated a second data of image pixels based on the RGBW color space.

Steps of performing compensating the white subpixel corresponding by the center point Ws via a predetermined normalized proportion through two subpixels corresponding to the other two color coordinate points, except the center point Ws, within the triangle region surrounding and locating the color coordinate point Wd comprises: if the color coordinate point Wd is located within the triangle region BsGsWs, a normalized proportion calculating a luminance among subpixel, the blue subpixel, green subpixel and white subpixel, is BsY, GsY, and WsY, and BsY+GsY+WsY=1; performing calibration process to the first data by applying the normalized proportion BsY, GsY, and WsY to obtain a second data of image pixels based on the RGBW color space, $$R_{fo}(i)=R_o(i)$$

$$G_{fo}(i)=G_o(i)+W_o(i)*G_sY(i),$$

$$B_{fo}(i)=B_o(i)+W_o(i)*B_sY(i)$$

$$W_{fo}(i)=W_o(i)*W_sY(i)$$

wherein Ro(i), Go(i), Bo(i), and Wo(i) are first data of a pixel point i, Rfo(i), Gfo(i), Bfo(i), Wfo(i) are second data of the pixel point i, BsY(i), GsY(i), and WsY(i) is a normalized proportion of a luminance among a blue subpixel, green subpixel and white subpixel of the pixel point i.

The normalized proportion BsY, GsY, and WsY is obtained according to formula 1, which is:

$$W_sY = \frac{B_sx*G_sy*W_sy - B_sy*G_sx*W_sy - B_sx*W_sy*W_dy + B_sy*W_sy*W_dx + G_sx*W_sy*W_dy - G_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy}$$

$$G_sY = \frac{B_sx*G_sy*W_sy - B_sy*G_sy*W_sx - B_sx*G_sy*W_dy + B_sy*G_sy*W_dx + G_sy*W_sx*W_dy - G_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy}$$

$$B_sY = \frac{B_sy*G_sx*W_sy - B_sy*G_sy*W_sx - B_sy*G_sx*W_dy + B_sy*G_sy*W_dx + B_sy*W_sx*W_dy - B_sy*W_sy*W_dx}{B_sx*G_sy*W_dy - B_sy*G_sx*W_dy - B_sx*W_sy*W_dy + B_sy*W_sx*W_dy + G_sx*W_sy*W_dy - G_sy*W_sx*W_dy},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

Steps for performing compensating the white subpixel corresponding by the center point Ws via a predetermined normalized proportion to calibrated the first data through the two subpixels corresponding to the other two color coordinate points, except the center point Ws, within the triangle region surrounding and locating the color coordinate point Wd comprises: if the color coordinate point Wd is located within the triangle region BsRsWs, a normalized proportion calculating a luminance among the blue subpixel, red subpixel and white subpixel, is BsY, RsY, and WsY, and BsY+RsY+WsY=1; performing calibration process to the first data by applying the normalized proportion BsY, RsY, and WsY to obtain a second data of image pixels based on the RGBW color space, $$R_{fo}(j)=R_o(j)+W_o(j)*R_sY(j)$$

$$G_{fo}(j)=G_o(j),$$

$$B_{fo}(j)=B_o(j)+W_o(j)*B_sY(j)$$

$$W_{fo}(j)=W_o(j)*W_sY(j)$$

wherein Ro(j), Go(j), Bo(j), and Wo(j) are first data of a pixel point j, Rfo(j), Gfo(j), Bfo(j), and Wfo(j) are second data of the pixel point j, BsY(j), RsY(j), and WsY(j) is a normalized proportion of a luminance among a blue subpixel, red subpixel and white subpixel of the pixel point j.

The normalized proportion BsY, RsY, and WsY is obtained according to formula 2, which is:

$$W_sY = \frac{B_sx*R_sy*W_sy - B_sy*R_sx*W_sy - B_sx*W_sy*W_dy + B_sy*W_sy*W_dx + R_sx*W_sy*W_dy - R_sy*W_sy*W_dx}{B_sx*R_sy*W_dy - B_sy*R_sx*W_dy - B_sx*W_sy*W_dy + B_sy*W_sx*W_dy + G_sx*W_sy*W_dy - R_sy*W_sx*W_dy},$$

-continued $$R_sY = \frac{B_sx*R_sy*W_sy - B_sy*R_sy*W_sx - B_sx*R_sy*W_dy + B_sy*R_sy*W_dx + R_sy*W_sx*W_dy - R_sy*W_sy*W_dx}{B_sx*R_sy*W_dy - B_sy*R_sx*W_dy - B_sx*W_sy*W_dy + B_sy*W_sx*W_dy + R_sx*W_sy*W_dy - R_sy*W_sx*W_dy}$$

$$B_sY = \frac{B_sy*R_sx*W_sy - B_sy*R_sy*W_sx - B_sy*R_sx*W_dy + B_sy*R_sy*W_dx + B_sy*W_sx*W_dy - B_sy*W_sy*W_dx}{B_sx*R_sy*W_dy - B_sy*R_sx*W_dy - B_sx*W_sy*W_dy + B_sy*W_sx*W_dy + R_sx*W_sy*W_dy - R_sy*W_sx*W_dy},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

Steps of performing compensating the white subpixel corresponding by the center point Ws via a predetermined normalized proportion through two subpixels corresponding to the other two color coordinate points, except the center point Ws, within the triangle region surrounding and locating the color coordinate point Wd comprises: if the color coordinate point Wd is located within the triangle region RsGsWs, a normalized proportion calculating a luminance among the red subpixel, green subpixel and white subpixel, is RsY, GsY, and WsY, and RsY+GsY+WsY=1; performing calibration process to the first data by applying the normalized proportion RsY, GsY, and WsY to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k),$$

$$B_{fo}(k)=B_o(k)$$

$$W_{fo}(k)=W_o(k)*W_sY(k)$$

wherein Ro(k), Go(k), Bo(k), and Wo(k) are first data of a pixel point k, Rfo(k), Gfo(k), Bfo(k), and Wfo(k) are second data of the pixel point k, RsY(k), GsY(k), and WsY(k) is a normalized proportion of a luminance among a red subpixel, green subpixel and white subpixel of the pixel point k.

The normalized proportion RsY, GsY, and WsY is obtained according to formula 3, which is:

$$W_sY = \frac{R_sx*G_sy*W_sy - R_sy*G_sx*W_sy - R_sx*W_sy*W_dy + R_sy*W_sy*W_dx + G_sx*W_sy*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$G_sY = \frac{R_sx*G_sy*W_sy - R_sy*G_sx*W_sx - R_sx*G_sy*W_dy + R_sy*G_sy*W_dx + G_sy*W_sx*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$R_sY = \frac{R_sy*G_sx*W_sy - R_sy*G_sy*W_sx - R_sy*G_sy*W_dx + R_sy*G_sy*W_dx + R_sy*W_sx*W_dy - R_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

To solve the aforementioned technical problem, another technical solution applied in the present invention is: an apparatus of RGBW compensation is provided based on color aberrations of white subpixel, aberrations exist between a color coordinate point Ws of white subpixel of image pixels on a RGBW panel and a standard white color coordinate point Wd under sRGB before compensating, and the apparatus comprises: an inserting module, used in inserting the image pixels based on a first data of RGBW color space; a dividing module, used in analyzing color coordinates of every subpixel of the image pixels on the RGBW panel, and then dividing a triangle RsGsBs with vertices color coordinate points Rs, Gs, and Bs of red subpixel, green subpixel and green pixel of the image points into three triangle regions, RsGsWs, RsBsWs, and BsGsWs, based on taking the color coordinate point Ws as the center point; a confirming module, used in confirming a triangle region where the color coordinate point is located based on ranges of the three triangle regions, RsGsWs, RsBsWs, and BsGsWs; a compensating module, used in performing compensating the white subpixel corresponding by the center point Ws via a predetermined normalized proportion to calibrated the first data through two subpixels corresponding to the other two color coordinate points, except the center point Ws, within the triangle region surrounding and locating the color coordinate point Wd; an exporting module, used in exporting the post-compensated a second data of image pixels based on the RGBW color space.

The compensating module comprises: a first calculating unit, used in while the color coordinate point Wd is located within the triangle region BsGsWs, a normalized proportion calculating a luminance among subpixel, the blue subpixel, green subpixel and white subpixel, is BsY, GsY, and WsY, and BsY+GsY+WsY=1; a first calibration unit, used in performing the calibration process to the first data by applying the normalized proportion BsY, GsY, and WsY to obtain a second data of image pixels based on the RGBW color space, $$R_{fo}(i)=R_o(i)$$

$$G_{fo}(i)=G_o(i)+W_o(i)*G_sY(i),$$

$$B_{fo}(i)=B_o(i)+W_o(i)*B_sY(i)$$

$$W_{fo}(i)=W_o(i)*W_sY(i)$$

wherein Ro(i), Go(i), Bo(i), and Wo(i) are first data of a pixel point i; Rfo(i), Gfo(i), Bfo(i), and Wfo(i) are second data of the pixel point i, BsY(i), GsY(i), and WsY(i) is a normalized proportion of a luminance among a blue subpixel, green subpixel and white subpixel of the pixel point i.

The normalized proportion BsY, GsY, and WsY is obtained according to formula 1, which is:

$$W_sY=\frac{\begin{array}{c}B_sx*G_sy*W_sy-B_sy*G_sx*W_sy-B_sx*W_sy*W_dy+\\B_sy*W_sy*W_dx+G_sx*W_sy*W_dy-G_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

-continued $$G_sY=\frac{\begin{array}{c}B_sx*G_sy*W_sy-B_sy*G_sy*W_sx-B_sx*G_sy*W_dy+\\B_sy*G_sy*W_dx+G_sy*W_sx*W_dy-G_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$B_sY=\frac{\begin{array}{c}B_sx*G_sx*W_sy-B_sy*G_sy*W_sx-B_sy*G_sx*W_dy+\\B_sy*G_sy*W_dx+B_sy*W_sx*W_dy-B_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

The compensating module comprises: a second calculating unit, used in while the color coordinate point Wd is located within the triangle region BsRsWs, a normalized proportion calculating a luminance among the blue subpixel, red subpixel and white subpixel, is BsY, RsY, and WsY, and BsY+RsY+WsY=1; a second calibration unit, used in performing calibration process to the first data by applying the normalized proportion BsY, RsY, and WsY to obtain a second data of image pixels based on the RGBW color space, $$R_{fo}(j)=R_o(j)+W_o(j)*R_sY(j)$$

$$G_{fo}(j)=G_o(j),$$

$$B_{fo}(j)=B_o(j)+W_o(j)*B_sY(j)$$

$$W_{fo}(j)=W_o(j)*W_sY(j)$$

wherein Ro(j), Go(j), Bo(j), and Wo(j) are first data of a pixel point j, Rfo(j), Gfo(j), Bfo(j), and Wfo(j) are second data of the pixel point j, BsY(j), RsY(j), and WsY(j) is a normalized proportion of a luminance among a blue subpixel, red subpixel and white subpixel of the pixel point j.

The normalized proportion BsY, RsY, and WsY is obtained according to formula 2, which is:

$$W_sY=\frac{\begin{array}{c}B_sx*R_sy*W_sy-B_sy*R_sx*W_sy-B_sx*W_sy*W_dy+\\B_sy*W_sy*W_dx+R_sx*W_sy*W_dy-R_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+G_sx*W_sy*W_dy-R_sy*W_sx*W_dy\end{array}}$$

$$R_sY=\frac{\begin{array}{c}B_sx*R_sy*W_sy-B_sy*R_sy*W_sx-B_sx*R_sy*W_dy+\\B_sy*R_sy*W_dx+R_sy*W_sx*W_dy-R_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}}$$

$$B_sY=\frac{\begin{array}{c}B_sy*R_sx*W_sy-B_sy*R_sy*W_sx-B_sy*R_sx*W_dy+\\B_sy*R_sy*W_dx+B_sy*W_sx*W_dy-B_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

The compensating module comprises: a third calculating unit, used in while the color coordinate point Wd is located within the triangle region RsGsWs, a normalized proportion calculating a luminance among the red subpixel, green subpixel and white subpixel, is RsY, GsY, and WsY, and RsY+GsY+WsY=1; a third calibration unit, used in performing calibration process to the first data by applying the normalized proportion RsY, GsY, and WsY to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k),$$

$$B_{fo}(k)=B_o(k)$$

$$W_{fo}(k)=W_o(k)*W_sY(k)$$

wherein Ro(k), Go(k), Bo(k), and Wo(k) are first data of a pixel point k, Rfo(k), Gfo(k), Bfo(k), and Wfo(k) are second data of the pixel point k, RsY(k), GsY(k), and WsY(k) is a normalized proportion of a luminance among a red subpixel, green subpixel and white subpixel of the pixel point k.

The n normalized proportion RsY, GsY, and WsY is obtained according to formula 3, which is:

$$W_sY=\frac{\begin{array}{c}R_sx*G_sy*W_sy-R_sy*G_sx*W_sy-R_sx*W_sy*W_dy+\\R_sy*W_sy*W_dx+G_sx*W_sy*W_dy-G_sy*W_sy*W_dx\end{array}}{\begin{array}{c}R_sx*G_sy*W_dy-R_sy*G_sx*W_dy-R_sx*W_sy*W_dy+\\R_sy*W_sx*W_dy+G_sx*W_sy*W_dy-G_sy*W_sx*W_dy\end{array}}$$

$$G_sY=\frac{\begin{array}{c}R_sx*G_sy*W_sy-R_sy*G_sy*W_sx-R_sx*G_sy*W_dy+\\R_sy*G_sy*W_dx+G_sx*W_sx*W_dy-G_sy*W_sy*W_dx\end{array}}{\begin{array}{c}R_sx*G_sy*W_dy-R_sy*G_sx*W_dy-R_sx*W_sy*W_dy+\\R_sy*W_sx*W_dy+G_sx*W_sy*W_dy-G_sy*W_sx*W_dy\end{array}}$$

$$R_sY=\frac{\begin{array}{c}R_sy*G_sx*W_sy-R_sy*G_sy*W_sx-R_sy*G_sy*W_dy+\\R_sy*G_sy*W_dx+R_sy*W_sx*W_dy-R_sy*W_sy*W_dx\end{array}}{\begin{array}{c}R_sx*G_sy*W_dy-R_sy*G_sx*W_dy-R_sx*W_sy*W_dy+\\R_sy*W_sx*W_dy+G_sx*W_sy*W_dy-G_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

The present invention can be concluded with the following advantages: as compared to the existing prior art, when aberrations exist between a color coordinate point Ws of white subpixel of image pixels and a standard white color coordinate point Wd under sRGB, analyzing color coordinates of every subpixel of the image pixels on the RGBW panel, and then dividing a triangle RsGsBs with vertices color coordinate points Rs, Gs, and Bs of red subpixel, green subpixel and green pixel of the image points into three triangle regions based on taking the color coordinate point Ws as the center point; based on ranges of the three triangle regions, RsGsWs, RsBsWs, and BsGsWs, a triangle region where the color coordinate point is located is confirmed; the first data is calibrated by performing compensating the white subpixel corresponding by the center point Ws via a predetermined normalized proportion through two subpixels corresponding to the other two color coordinate points, except the center point Ws, within the triangle region surrounding and locating the color coordinate point Wd. Because the first data can be calibrated by performing compensating the white subpixel corresponding by the center point Ws via a predetermined normalized proportion through two subpixels corresponding to the other two color coordinate points, except the center point Ws, within the triangle region surrounding and locating the color coordinate point Wd; therefore, the situation of aberrations of white subpixels can be calibrated specifically and further images of GRBW panels can be normalized.

DETAILED DESCRIPTION OF THE PREFERRED EMBODIMENTS

Figure 1:
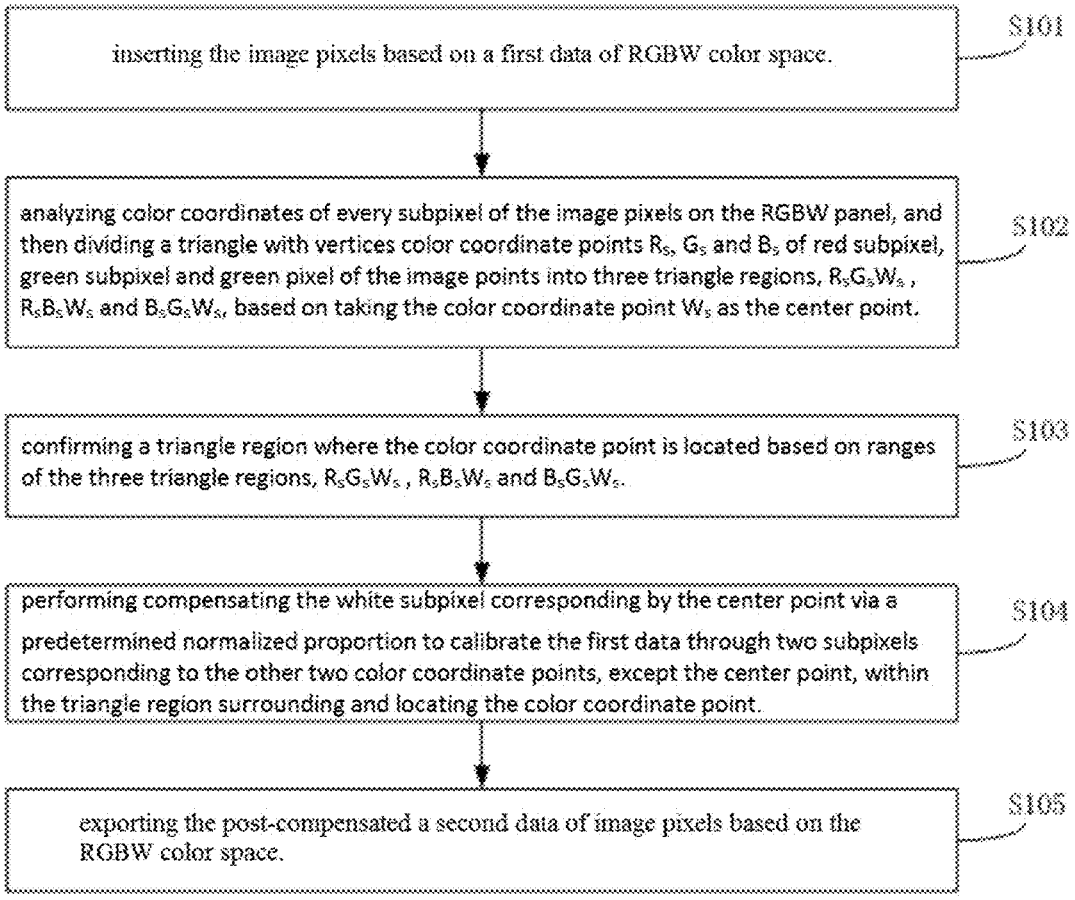
FIG. 1 is a flowchart of an embodiment representing a method of RGBW compensation based on color aberrations of white subpixel in the present invention.

Detailed descriptions will be given along with the embodiment illustrated in the attached drawings. FIG. 1 is a flowchart of an embodiment representing a method of RGBW compensation based on color aberrations of white subpixel in the present invention.

Referring to FIG. 1, FIG. 1 is a flowchart of an embodiment representing a method of RGBW compensation based on color aberrations of white subpixel in the present invention. Before performing compensating via method adopted in the present invention, aberrations exist between a color coordinate point Ws of white subpixel of image pixels on a RGBW panel and a standard white color coordinate point Wd under sRGB, and the method comprises:

Step S101: inserting the image pixels based on a first data of RGBW color space.

Step S102: analyzing color coordinates of every subpixel of the image pixels on the RGBW panel, and then dividing a triangle RsGsBs with vertices color coordinate points Rs, Gs, and Bs of red subpixel, green subpixel and green pixel of the image points into three triangle regions, RsGsWs, RsBsWs, and BsGsWs, based on taking the color coordinate point Ws as the center point.

Figure 2:
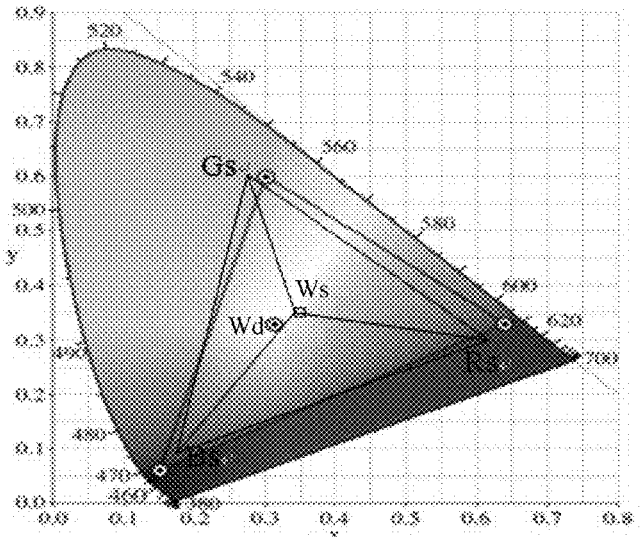
FIG. 2 is schematic diagram showing positions of four subpixels with reference to chromaticity diagram in an embodiment.

Respective subpixel of image pixels on RGBW panels can be represented by a particular coordinate point with reference to chromaticity diagram, and the particular coordinate point herein has a particular color coordinate value (x, y). There are four kinds of subpixels in the image pixels on RGBW panels, and those are red subpixels, green subpixels, blue subpixels and white subpixels respectively. Referring to FIG. 2, these four subpixels are corresponding to the color coordinate points, Rs, Gs, Bs and Ws, positioned in the surrounding triangle RsGsBs, and the triangle RsGsBs is divided into three triangles regions, RsGsWs, RsBsWs, and BsGsWs, based on taking the color coordinate point Ws as the center point.

Step 103: confirming a triangle region where the color coordinate point is located based on ranges of the three triangle regions, RsGsWs, RsBsWs, and BsGsWs.

Right after ranges of the three triangle regions, RsGsWs, RsBsWs, and BsGsWs, are confirmed, the color coordinate point Wd located within a triangle region can be confirmed as well, as shown in FIG. 2. In a particular example, a coordinate value of the standard white color coordinate point Wd under sRGB is (0.3127, 0.329) (as shown in white circle of the triangle RsGsBs), and a coordinate value of the color coordinate point Ws of the image pixels is (0.34, 0.35) (as shown in the white block in the triangle RsGsBs); the triangle region where Wd is located is BsGsWs.

Step 104: performing compensating the white subpixel corresponding by the center point Ws via a predetermined normalized proportion to calibrate the first data through two subpixels corresponding to the other two color coordinate points, except the center point Ws, within the triangle region surrounding and locating the color coordinate point Wd.

Wd is a standard white color coordinate point, and Wd is located at a particular triangle region, and when aberrations existing between Ws and W, means calibration needed for Ws; when calibration is performing, the rest subpixels exhibit largest influence upon the white subpixels within the triangle region; therefore, the calibration is performed by adopting two subpixels corresponding to the other two color coordinate points, except Ws, within the triangle region surrounding and locating the color coordinate point Wd, and when the calibration is performed, influences of the two subpixels is confirmed by a predetermined normalized proportion.

The predetermined normalized proportion not only can be confirmed by performing calculations of coordinate values and standard optical calculating formulas, but can also be confirmed by experimental data.

Step 105: exporting the post-compensated a second data of image pixels based on the RGBW color space.

In embodiments of the present invention, when aberrations exist between a color coordinate point Ws of white pixels of image pixels and a standard white color coordinate point Wd under sRGB, color coordinates of every subpixel of the image pixels on the RGBW panel are analyzed, and then a triangle RsGsBs with vertices color coordinate points Rs, Gs, and Bs of red subpixel, green subpixel and green pixel of the image points is divided into three triangle regions, RsGsWs, RsBsWs, and BsGsWs, based on taking the color coordinate point Ws as the center point; based on ranges of the three triangle regions, RsGsWs, RsBsWs, and BsGsWs, a triangle region where the color coordinate point is located is confirmed; the first data is calibrated by performing compensating the white subpixel corresponding by the center point Ws via a predetermined normalized proportion through two subpixels corresponding to the other two color coordinate points, except the center point Ws, within the triangle region surrounding and locating the color coordinate point Wd. Because the first data can be calibrated by performing compensating the white subpixel corresponding by the center point Ws via a predetermined normalized proportion through two subpixels corresponding to the other two color coordinate points, except the center point Ws, within the triangle region surrounding and locating the color coordinate point Wd; therefore, the situation of aberrations of white subpixels can be calibrated specifically and further images of GRBW panels can be normalized.

Figure 3:
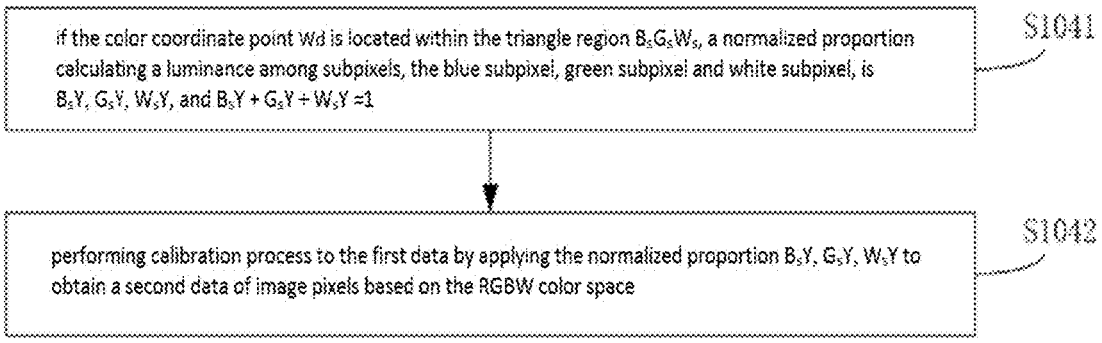
FIG. 3 is a flowchart of another embodiment representing a method of RGBW compensation based on color aberrations of white subpixel in the present invention.

As shown in FIG. 3, Step S104 can particularly include: substep S1041 and substep S1042.

Substep S1041: if the color coordinate point Wd is located within the triangle region BsGsWs, a normalized proportion calculating a luminance among subpixels, the blue subpixel, green subpixel and white subpixel, is BsY, GsY, and WsY, and BsY+GsY+WsY=1.

Substep S1042: performing calibration process to the first data by applying the normalized proportion BsY, GsY, and WsY to obtain a second data of image pixels based on the RGBW color space, $$R_{fo}(i)=R_o(i)$$

$$G_{fo}(i)=G_o(i)+W_o(i)*G_sY(i),$$

$$B_{fo}(i)=B_o(i)+W_o(i)*B_sY(i)$$

$$W_{fo}(i)=W_o(i)*W_sY(i)$$

wherein Ro(i), Go(i), Bo(i), and Wo(i) are first data of a pixel point i, Rfo(i), Gfo(i), Bfo(i), Wfo(i) are second data of the pixel point i, BsY(i), GsY(i), and WsY(i) is a normalized proportion of a luminance among a blue subpixel, green subpixel and white subpixel of the pixel point i.

If the color coordinate point Wd is located within the triangle region BsRsWs, that means when calibrating, performing calibration of white subpixels can adopt blue subpixels and green subpixels to do so. In particular, a normalized proportion calculating a luminance among the blue subpixel, red subpixel and white subpixels BsY, RsY, and WsY, and wherein BsY+RsY+WsY=1. Right after normalized proportion BsY, RsY, and WsY is confirmed, the first data can be performed in calibrating to get the second data of image pixels according to RGBW color space.

The first data is data based on RGBW color space, and before the first data is obtained, the original data Ri, Gi, and Bi based on RGB color space is transferred into a first data Ro, Go, Bo, and Wo based on RGBW color space by traditional RGBW transferred calculation or other calculations different from RGBW transferred calculation. Next, after implementing the method of the present invention, calibrations are performed to situations of aberrations of white subpixels to normalize images of the RGBW panels.

Figure 4:
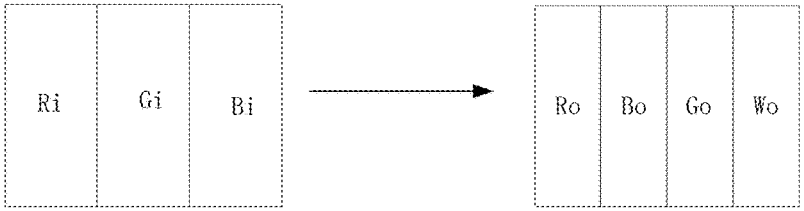
FIG. 4 is a schematic diagram of a first data based on RGB color space transferred from original databased on RGBW color space.

For example, as shown in FIG. 4, after transferring the original data Ri, Gi, and Bi based on RGB color space into the first data Ro, Go, Bo, and Wo based on RGBW color space to $$R_o=R_i-W_o$$

$$G_o=G_i-W_o$$

obtain. Next, after implementing the method of the present invention, the $$B_o=B_i-W_o$$

$$W_o=\min[R_i,G_i,B_i]$$

calibration performed to situations of aberrations of white subpixels to normalize images of the $$R_o=R_i-W_o$$

$$G_o=G_i-W_o$$

RGBW panels, such as $$B_o=B_i-W_o$$

$$W_o=\min[R_i,G_i,B_i].$$

The normalized proportion BsY, GsY, and WsY is obtained according to formula 1, which is:

$$W_sY=\frac{\begin{array}{l}B_sx*G_sy*W_sy-B_sy*G_sx*W_sy-B_sx*W_sy*W_dy+\\B_sy*W_sy*W_dx+G_sx*W_sy*W_dy-G_sy*W_sy*W_dx\end{array}}{\begin{array}{l}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$G_sY=\frac{\begin{array}{l}B_sx*G_sy*W_sy-B_sy*G_sy*W_sx-B_sx*G_sy*W_dy+\\B_sy*G_sy*W_dx+G_sy*W_sx*W_dy-G_sy*W_sy*W_dx\end{array}}{\begin{array}{l}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$B_sY=\frac{\begin{array}{l}B_sy*G_sx*W_sy-B_sy*G_sy*W_sx-B_sy*G_sx*W_dy+\\B_sy*G_sy*W_dx+B_sy*W_sx*W_dy-B_sy*W_sy*W_dx\end{array}}{\begin{array}{l}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

The derivation of the aforementioned formula 1 is as follows: X, Y and Z are three stimulus values, wherein Y represents luminance; x and y are color coordinate values; fixed conjunctive formulas are existing between (X, Y, Z) and (x, y): x=X/(X+Y+Z) and y=Y/(X+Y+Z).

According to the aforementioned conjunctive formulas, the next formula can be obtained:

$$WsX/(WsX+WsY+WsZ)=Wsx \quad (1)$$

$$WsY/(WsX+WsY+WsZ)=Wsy \quad (2)$$

$$GsX/(GsX+GsY+GsZ)=Gsx \quad (3)$$

$$GsY/(GsX+GsY+GsZ)=Gsy \quad (4)$$

$$BsX/(BsX+BsY+BsZ)=Bsx \quad (5)$$

$$BsY/(BsX+BsY+BsZ)=Bsy \quad (6)$$

$$WsY+GsY+BsY=1 \quad (7)$$

$$(WsX+GsX+BsX)/(WsX+GsX+BsX+WsY+GsY+BsY+WsZ+GsZ+BsZ)=Wdx \quad (8)$$

$$(WsY+GsY+BsY)/(WsX+GsX+BsX+WsY+GsY+BsY+WsZ+GsZ+BsZ)=Wdy \quad (9)$$

In the aforementioned 9 formulas, WsX, WsY, and WsZ are three respective stimulus values of a white pixel of a particular pixel and are unknowns to find a solution; GsX, GsY, and GsZ are three respective stimulus values of a green pixel of a particular pixel and are unknowns to find a solution; BsX, BsY, and BsZ are three respective stimulus values of a blue pixel of a particular pixel and are unknowns to find a solution. (Bsx, Bsy) is a coordinate value of the blue subpixel of the image pixel on RGBW panel, and is a known value on RGBW panel; (Gsx,Gsy) is a coordinate value of the green subpixel of the image pixel on RGBW panel, and is a known value on RGBW panel; (Wsx, Wsy) is a coordinate value of the white subpixel of the image pixel on RGBW panel, and is a known value on RGBW panel; (Wdx, Wdy) is a standard white coordinate under sRGB, and is a known value.

In the aforementioned 9 formulas, after solving 9 unknowns, luminance signal thereof can be solved then: WsY, GsY, and BsY is also a normalized proportion.

Figure 5:
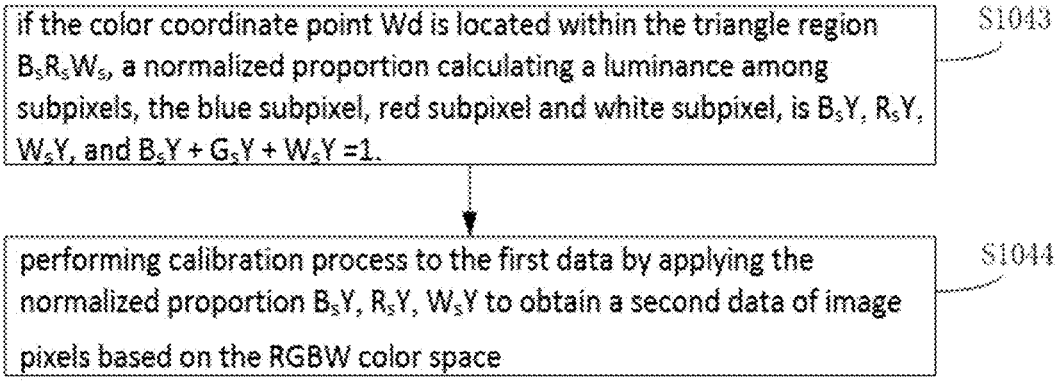
FIG. 5 is a flowchart of still another embodiment representing a method of RGBW compensation based on color aberrations of white subpixel in the present invention.

As shown in FIG. 5, Step S104 can particularly include: Substep S1043 and Substep S1044.

Substep S1043: if the color coordinate point Wd is located within the triangle region BsRsWs, a normalized proportion calculating a luminance among subpixels, the blue subpixel, red subpixel and white subpixel, is BsY, RsY, and WsY, and BsY+RsY+WsY=1.

Substep S1044: performing calibration process to the first data by applying the normalized proportion BsY, RsY, and WsY to obtain a second data of image pixels based on the RGBW color space, $$R_{fo}(j)=R_o(j)+W_o(j)*R_sY(j)$$

$$G_{fo}(j)=G_o(j),$$

$$B_{fo}(j)=B_o(j)+W_o(j)*B_sY(j)$$

$$W_{fo}(j)=W_o(j)*W_sY(j)$$

wherein Ro(j), Go(j), Bo(j), and Wo(j) are first data of a pixel point j, Rfo(j), Gfo(j), Bfo(j), and Wfo(j) are second data of the pixel point j, BsY(j), RsY(j), and WsY(j) is a normalized proportion of a luminance among a blue subpixel, red subpixel and white subpixel of the pixel point j The normalized proportion BsY, RsY, and WsY is obtained according to formula 2, which is:

$$W_sY=\frac{\begin{array}{l}B_sx*R_sy*W_sy-B_sy*R_sx*W_sy-B_sx*W_sy*W_dy+\\B_sy*W_sy*W_dx+R_sx*W_sy*W_dy-R_sy*W_sy*W_dx\end{array}}{\begin{array}{l}B_sx*R_sy*W_dy-B_sy*R_sx*W_dy-B_sx*W_sy*W_dy+\\B_sy*W_sx*W_dy+G_sx*W_sy*W_dy-R_sy*W_sx*W_dy\end{array}}$$

$$R_sY=\frac{\begin{array}{l}B_sx*R_sy*W_sy-B_sy*R_sy*W_sx-B_sx*R_sy*W_dy+\\B_sy*R_sy*W_dx+R_sy*W_sx*W_dy-R_sy*W_sy*W_dx\end{array}}{\begin{array}{l}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}}$$

$$B_sY=\frac{\begin{array}{l}B_sy*R_sx*W_sy-B_sy*R_sy*W_sx-B_sy*R_sx*W_dy+\\B_sy*R_sy*W_dx+B_sy*W_sx*W_dy-B_sy*W_sy*W_dx\end{array}}{\begin{array}{l}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

Figure 6:
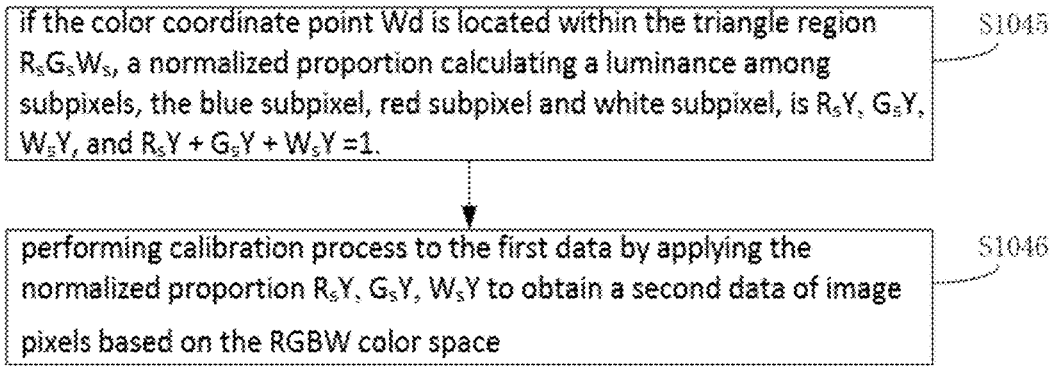
FIG. 6 is a flowchart of still another embodiment representing a method of RGBW compensation based on color aberrations of white subpixel in the present invention.

As shown in FIG. 6, step S104 can particularly include: Substep S1045 and Substep S1046.

Substep S1045: if the color coordinate point Wd is located within the triangle region RsGsWs, a normalized proportion calculating a luminance among subpixels, the red subpixel, green subpixel and white subpixel, is RsY, GsY, and WsY, and RsY+GsY+WsY=1.

Substep S1046: performing calibration process to the first data by applying the normalized proportion RsY, GsY, and WsY to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k),$$

$$B_{fo}(k)=B_o(k)$$

$$W_{fo}(k)=W_o(k)*W_sY(k)$$

wherein Ro(k), Go(k), Bo(k), and Wo(k) are first data of a pixel point k, Rfo(k), Gfo(k), Bfo(k), and Wfo(k) are second data of the pixel point k, RsY(k), GsY(k), and WsY(k) is a normalized proportion of a luminance among a red subpixel, green subpixel and white subpixel of the pixel point k.

The normalized proportion RsY, GsY, and WsY is obtained according to formula 3, which is:

$$W_sY=\frac{R_sx*G_sy*W_sy-R_sy*G_sx*W_sy-R_sx*W_sy*W_dy+R_sy*W_sy*W_dx+G_sx*W_sy*W_dy-G_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy}$$

$$G_sY=\frac{R_sx*G_sy*W_sy-R_sy*G_sy*W_sx-R_sx*G_sy*W_dy+R_sy*G_sy*W_dx+G_sx*W_sx*W_dy-G_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy}$$

$$R_sY=\frac{R_sy*G_sx*W_sy-R_sy*G_sy*W_sx-R_sy*G_sy*W_dy+R_sy*G_sy*W_dx+R_sy*W_sx*W_dy-R_sy*W_sy*W_dx}{R_sx*G_sy*W_dy-R_sy*G_sx*W_dy-R_sx*W_sy*W_dy+R_sy*W_sx*W_dy+G_sx*W_sy*W_dy-G_sy*W_sx*W_dy},$$

$$W_sY=\frac{B_sx*R_sy*W_sy-B_sy*R_sx*W_sy-B_sx*W_sy*W_dy+B_sy*W_sy*W_dx+R_sx*W_sy*W_dy-R_sy*W_sy*W_dx}{B_sx*R_sy*W_dy-B_sy*R_sx*W_dy-B_sx*W_sy*W_dy+B_sy*W_sx*W_dy+G_sx*W_sy*W_dy-R_sy*W_sx*W_dy}$$

$$R_sY=\frac{B_sx*R_sy*W_sy-B_sy*R_sy*W_sx-B_sx*R_sy*W_dy+B_sy*R_sy*W_dx+R_sy*W_sx*W_dy-R_sy*W_sy*W_dx}{B_sx*R_sy*W_dy-B_sy*R_sx*W_dy-B_sx*W_sy*W_dy+B_sy*W_sx*W_dy+R_sx*W_sy*W_dy-R_sy*W_sx*W_dy}$$

$$B_sY=\frac{B_sy*R_sx*W_sy-B_sy*R_sy*W_sx-B_sy*R_sx*W_dy+B_sy*R_sy*W_dx+B_sy*W_sx*W_dy-B_sy*W_sy*W_dx}{B_sx*R_sy*W_dy-B_sy*R_sx*W_dy-B_sx*W_sy*W_dy+B_sy*W_sx*W_dy+R_sx*W_sy*W_dy-R_sy*W_sx*W_dy},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

Figure 7:
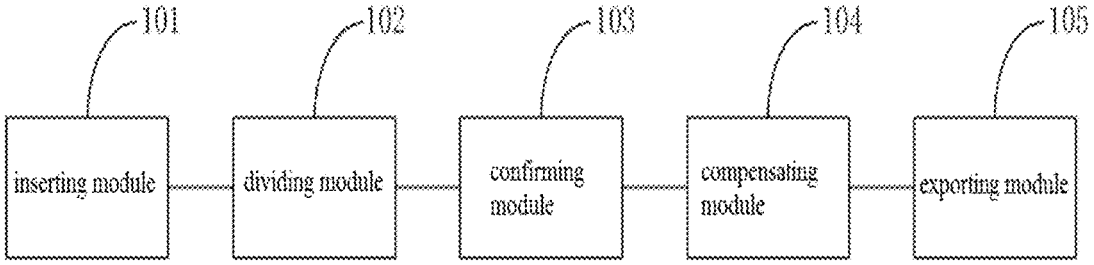
FIG. 7 is a schematic diagram showing a structure of an apparatus of an embodiment of RGBW compensation based on color aberrations of white subpixel.

Referring to FIG. 7, FIG. 7 is a schematic diagram showing a structure of an apparatus of an embodiment for compensation based on color aberrations of white subpixel; the apparatus can implementing the steps in the aforementioned method, and detail descriptions of relative contents can refer to corresponding description in the aforementioned method and will not be repeated here.

Aberrations exist between a color coordinate point Ws of white subpixel of image pixels on a RGBW panel and a standard white color coordinate point Wd under sRGB before compensating, and the apparatus comprises: an inserting module 101, a dividing module 102, a confirming module 103, a compensating module 104 and an exporting module 105.

The inserting module 101 is used in inserting the image pixels based on a first data of RGBW color space.

The dividing module 102 is used in analyzing color coordinates of every subpixel of the image pixels on the RGBW panel, and then dividing a triangle RsGsBs with vertices color coordinate points Rs, Gs and Bs of red subpixel, green subpixel and green pixel of the image points into three triangle regions, RsGsWs, RsBsWs, and BsGsWs, based on taking the color coordinate point Ws as the center point.

The confirming module 103 is used in confirming a triangle region where the color coordinate point is located based on ranges of the three triangle regions, RsGsWs, RsBsWs, and BsGsWs.

The compensating module 104 is used in performing compensating the white subpixel corresponding by the center point Ws via a predetermined normalized proportion to calibrate the first data through two subpixels corresponding to the other two color coordinate points, except the center point Ws, within the triangle region surrounding and locating the color coordinate point Wd.

The exporting module 105 is used in exporting the post-compensated a second data of image pixels based on the RGBW color space.

In embodiments of the present invention, when aberrations exist between a color coordinate point Ws of white pixels of image pixels and a standard white color coordinate point Wd under sRGB, color coordinates of every subpixel of the image pixels on the RGBW panel are analyzed, and then a triangle RsGsBs with vertices color coordinate points Rs, Gs and Bs of red subpixel, green subpixel and green pixel of the image points is divided into three triangle regions, RsGsWs, RsBsWs, and BsGsWs, based on taking the color coordinate point Ws as the center point; based on ranges of the three triangle regions, RsGsWs, RsBsWs, and BsGsWs, a triangle region where the color coordinate point is located is confirmed; the first data is calibrated by performing compensating the white subpixel corresponding by the center point Ws via a predetermined normalized proportion through two subpixels corresponding to the other two color coordinate points, except the center point Ws, within the triangle region surrounding and locating the color coordinate point Wd. Because the first data can be calibrated by performing compensating the white subpixel corresponding by the center point Ws via a predetermined normalized proportion through two subpixels corresponding to the other two color coordinate points, except the center point Ws, within the triangle region surrounding and locating the color coordinate point Wd; therefore, the situation of aberrations of white subpixels can be calibrated specifically and further images of GRBW panels can be normalized.

Figure 8:
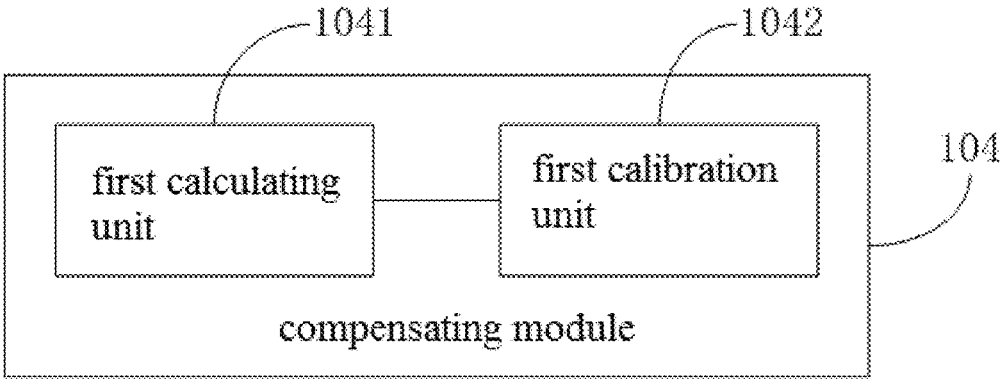
FIG. 8 is a schematic diagram showing a structure of an apparatus of another embodiment of RGBW compensation based on color aberrations of white subpixel.

Referring to FIG. 8, the compensating module 104 comprises: a first calculating unit 1041 and a first calibration unit 1042.

The first calculating unit 1041 is used in while the color coordinate point Wd is located within the triangle region BsGsWs, a normalized proportion calculating a luminance among subpixels, the blue subpixel, green subpixel and white subpixel, is BsY, GsY, and WsY, and BsY+GsY+WsY=1.

The first calibration unit 1042 is used in performing the calibration process to the first data by applying the normalized proportion BsY, GsY, and WsY to obtain a second data of image pixels based on the RGBW color space, $$R_{fo}(i)=R_o(i)$$

$$G_{fo}(i)=G_o(i)+W_o(i)*G_sY(i),$$

$$B_{fo}(i)=B_o(i)+W_o(i)*B_sY(i)$$

$$W_{fo}(i)=W_o(i)*W_sY(i)$$

wherein Ro(i), Go(i), Bo(i), and Wo(i) are first data of a pixel point i; Rfo(i), Gfo(i), Bfo(i), and Wfo(i) are second data of the pixel point i, BsY(i), GsY(i), and WsY(i) is a normalized proportion of a luminance among a blue subpixel, green subpixel and white subpixel of the pixel point i.

The normalized proportion BsY, GsY, and WsY is obtained according to formula 1, which is:

$$W_sY=\frac{\begin{array}{c}B_sx*G_sy*W_sy-B_sy*G_sx*W_sy-B_sx*W_sy*W_dy+\\B_sy*W_sy*W_dx+G_sx*W_sy*W_dy-G_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$G_sY=\frac{\begin{array}{c}B_sx*G_sy*W_sy-B_sy*G_sy*W_sx-B_sx*G_sy*W_dy+\\B_sy*G_sy*W_dx+G_sy*W_sx*W_dy-G_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}}$$

$$B_sY=\frac{\begin{array}{c}B_sy*G_sx*W_sy-B_sy*G_sy*W_sx-B_sy*G_sx*W_dy+\\B_sy*G_sy*W_dx+B_sy*W_sx*W_dy-B_sy*W_sy*W_dx\end{array}}{\begin{array}{c}B_sx*G_sy*W_dy-B_sy*G_sx*W_dy-B_sx*W_sy*W_dy+\\B_sy*W_sx*W_dy+G_sx*W_sy*W_dy-G_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

Figure 9:
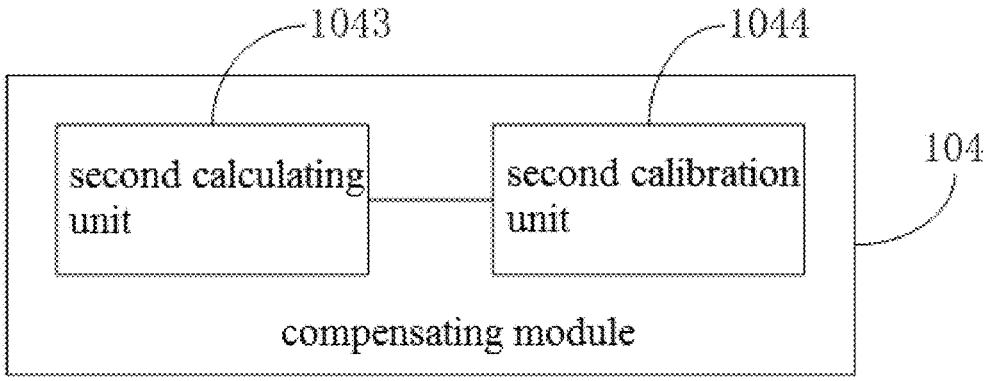
FIG. 9 is a schematic diagram showing a structure of an apparatus of still another embodiment of RGBW compensation based on color aberrations of white subpixel.

Referring to FIG. 9, the compensating module 104 comprises: a second calculating unit 1043 and a second calibration unit 1044.

The second calculating unit 1043 is used in while the color coordinate point Wd is located within the triangle region BsRsWs, a normalized proportion calculating a luminance among the blue subpixel, red subpixel and white subpixel, is BsY, RsY, and WsY, and BsY+RsY+WsY=1

The second calibration unit 1044 is used in performing calibration process to the first data by applying the normalized proportion BsY, RsY, and WsY to obtain a second data of image pixels based on the RGBW color space, $$R_{fo}(j)=R_o(j)+W_o(j)*R_sY(j)$$

$$G_{fo}(j)=G_o(j),$$

$$B_{fo}(j)=B_o(j)+W_o(j)*B_sY(j)$$

$$W_{fo}(j)=W_o(j)*W_sY(j)$$

wherein Ro(j), Go(j), Bo(j), and Wo(j) are first data of a pixel point j, Rfo(j), Gfo(j), Bfo(j), and Wfo(j) are second data of the pixel point j, BsY(j), RsY(j), and WsY(j) is a normalized proportion of a luminance among a blue subpixel, red subpixel and white subpixel of the pixel point j.

The normalized proportion BsY, RsY, and WsY is obtained according to formula 2, which is:

$$W_sY=\frac{\begin{array}{c}B_sx*R_sy*W_sy-B_sy*R_sx*W_sy-B_sx*W_sy*W_dy+\\B_sy*W_sy*W_dx+R_sx*W_sy*W_dy-R_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+G_sx*W_sy*W_dy-R_sy*W_sx*W_dy\end{array}}$$

$$R_sY=\frac{\begin{array}{c}B_sx*R_sy*W_sy-B_sy*R_sy*W_sx-B_sx*R_sy*W_dy+\\B_sy*R_sy*W_dx+R_sy*W_sx*W_dy-R_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}}$$

$$B_sY=\frac{\begin{array}{c}B_sy*R_sx*W_sy-B_sy*R_sy*W_sx-B_sy*R_sx*W_dy+\\B_sy*R_sy*W_dx+B_sy*W_sx*W_dy-B_sy*W_sy*W_dx\end{array}}{\begin{array}{c}B_sx*R_sy*W_dy-B_sy*R_sx*W_dy-B_sx*W_sy*W_dy+\\B_sy*W_sx*W_dy+R_sx*W_sy*W_dy-R_sy*W_sx*W_dy\end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

Figure 10:
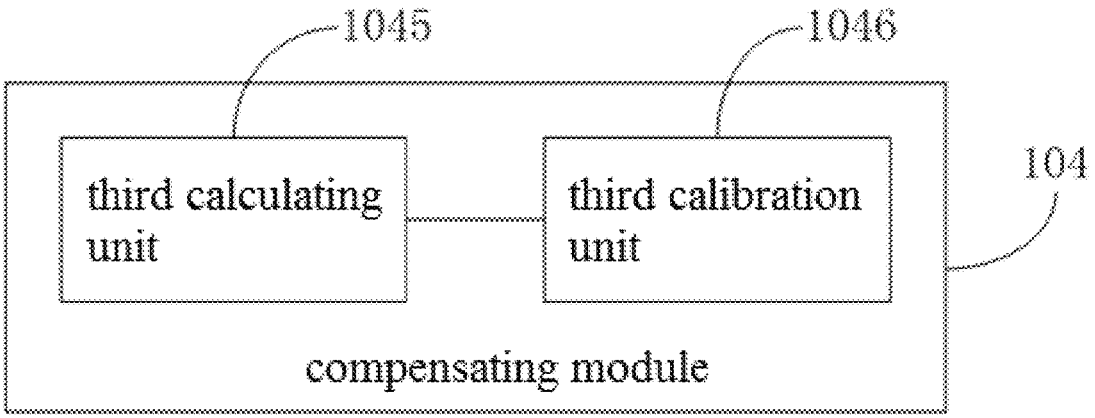
FIG. 10 is a schematic diagram showing a structure of still another apparatus of an embodiment of RGBW compensation based on color aberrations of white subpixel.

Referring to FIG. 10, the compensating module 104 comprises: a third calculating unit 1045 and a third calibration unit 1046.

The third calculating unit 1045 is used in while the color coordinate point Wd is located within the triangle region RsGsWs, a normalized proportion calculating a luminance among the red subpixel, green subpixel and white subpixel, is RsY, GsY, and WsY, and RsY+GsY+WsY=1.

The third calibration unit 1046 is used in performing calibration process to the first data by applying the normalized proportion RsY, GsY, and WsY to obtain a second data of image pixels based on the RGBW color space, $$R_{fo}(k)=R_o(k)+W_o(k)*R_sY(k)$$

$$G_{fo}(k)=G_o(k)+W_o(k)*G_sY(k),$$

$$B_{fo}(k)=B_o(k)$$

$$W_{fo}(k)=W_o(k)*W_sY(k)$$

wherein Ro(k), Go(k), Bo(k), and Wo(k) are first data of a pixel point k, Rfo(k), Gfo(k), Bfo(k), and Wfo(k) are second data of the pixel point k, RsY(k), GsY(k), and WsY(k) is a normalized proportion of a luminance among a red subpixel, green subpixel and white subpixel of the pixel point k.

The n normalized proportion RsY, GsY, and WsY is obtained according to formula 3, which is:

$$W_sY = \frac{\begin{array}{c} R_sx*G_sy*W_sy - R_sy*G_sx*W_sy - R_sx*W_sy*W_dy + \\ R_sy*W_sy*W_dx + G_sx*W_sy*W_dy - G_sy*W_sy*W_dx \end{array}}{\begin{array}{c} R_sx*G_sy*W_dy - R_sy*G_sx*W_dy - R_sx*W_sy*W_dy + \\ R_sy*W_sx*W_dy + G_sx*W_sy*W_dy - G_sy*W_sx*W_dy \end{array}}$$

$$G_sY = \frac{\begin{array}{c} R_sx*G_sy*W_sy - R_sy*G_sy*W_sx - R_sx*G_sy*W_dy + \\ R_sy*G_sy*W_dx + G_sx*W_sx*W_dy - G_sy*W_sy*W_dx \end{array}}{\begin{array}{c} R_sx*G_sy*W_dy - R_sy*G_sx*W_dy - R_sx*W_sy*W_dy + \\ R_sy*W_sx*W_dy + G_sx*W_sy*W_dy - G_sy*W_sx*W_dy \end{array}}$$

$$R_sY = \frac{\begin{array}{c} R_sy*G_sx*W_sy - R_sy*G_sy*W_sx - R_sy*G_sy*W_dy + \\ R_sy*G_sy*W_dx + R_sy*W_sx*W_dy - R_sy*W_sy*W_dx \end{array}}{\begin{array}{c} R_sx*G_sy*W_dy - R_sy*G_sx*W_dy - R_sx*W_sy*W_dy + \\ R_sy*W_sx*W_dy + G_sx*W_sy*W_dy - G_sy*W_sx*W_dy \end{array}},$$

wherein (Bsx, Bsy) is a coordinate of a coordinate point of blue subpixel of a pixel point, (Gsx, Gsy) is a coordinate of a coordinate point of green subpixel of the pixel point, (Wsx, Wsy) is a coordinate of a coordinate point of white subpixel of the pixel point, and (Wdx, Wdy) is a coordinate of a standard white color coordinate point under sRGB.

Even though information and the advantages of the present embodiments have been set forth in the foregoing description, together with details of the mechanisms and functions of the present embodiments, the disclosure is illustrative only; and that changes may be made in detail, especially in matters of shape, size and arrangement of parts within the principles of the present embodiments to the full extend indicated by the broad general meaning of the terms in which the appended claims are expressed.

What is claimed is:

1. A method of RGBW compensation based on a color aberration of a white subpixel, wherein color aberration exists between a color coordinate point Ws of the white subpixel of an image pixel on a RGBW panel defined in a RGBW color space and a standard white color coordinate point Wd in an sRGB system before compensating, the method comprising the following steps:

supplying first data of the image pixel defined in the RGBW color space, which includes color coordinates of each of a red subpixel, a blue subpixel, a green subpixel, and a white subpixel of the image pixel on the RGBW panel and respectively define a red color coordinate point Rs, a blue color coordinate point Bs, a green color coordinate point Gs, and the white color coordinate point Ws in the RGBW color space;

processing the color coordinates of the red, blue, green, and while subpixels of the image pixel on the RGBW panel to define a triangle RsGsBs with vertices being defined by the color coordinate points Rs, Gs, and Bs of the red subpixel, the green subpixel and the green pixel of the image pixel, the triangle being divided into three triangular regions, which are respectively defined as a first triangular region RsGsWs, a second triangular region GsBsWs, and a third triangular region BsRsWs, having vertices respectively defined by the red, green, and white color coordinate points Rs, Gs, Ws, the green, blue, and white color coordinate points Gs, Bs, Ws, and the blue, red, and while color coordinate points Bs, Rs, Ws, with the white color coordinate point Ws as a center point;

determining one of the three triangular regions, RsGsWs, GsBsWs, and BsRsWs, where the standard color coordinate point Wd is located, wherein the three vertices of the one of the three triangular regions include the center point Ws and two outer points, which are two of the red, green, and blue color coordinate points Rs, Gs, Bs;

compensating the white subpixel by applying a predetermined normalized proportion operation to the first data of the color coordinates corresponding to the two outer points of the one of the three triangular regions in order to correct the first data to form second data of the image pixel;

outputting the second data of the image pixel based on the RGBW color space;

wherein the predetermined normalized proportion operation is carried out as follows:

when the one of the three triangular regions in which the standard white color coordinate point Wd is located is the triangular region GsBsWs, calculating a normalized proportion of luminance among the blue subpixel, green subpixel and white subpixel as BsY, GsY, WsY, wherein BsY+GsY+WsY=1;

applying the normalized proportion BsY, GsY, WsY to correct the first data to obtain the second data of the image pixel based on the RGBW color space, where $$Rfo(i)=Ro(i),$$

$$Gfo(i)=Go(i)+Wo(i)*GsY(i),$$

$$Bfo(i)=Bo(i)+Wo(i)*BsY(i), \text{ and}$$

$$Wfo(i)=Wo(i)*WsY(i),$$

wherein Ro(i), Go(i), Bo(i), and Wo(i) are the first data of a pixel point i, Rfo(i), Gfo(i), Bfo(i), and Wfo(i) are the second data of the pixel point i, BsY(i), GsY(i), and WsY(i) represent the normalized proportion of luminance among the blue subpixel, the green subpixel and the white subpixel of the pixel point i.

2. The method according to claim 1, wherein the normalized proportion of luminance among the blue subpixel, green subpixel and white subpixel, BsY, GsY, WsY, is obtained according to the following formula:

$$W_sY = \frac{\begin{array}{c} B_sx*G_sy*W_sy - B_sy*G_sx*W_sy - B_sx*W_sy*W_dy + \\ B_sy*W_sy*W_dx + G_sx*W_sy*W_dy - G_sy*W_sy*W_dx \end{array}}{\begin{array}{c} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}}$$

$$G_sY = \frac{\begin{array}{c} B_sx*G_sy*W_sy - B_sy*G_sy*W_sx - B_sx*G_sy*W_dy + \\ B_sy*G_sy*W_dx + G_sy*W_sx*W_dy - G_sy*W_sy*W_dx \end{array}}{\begin{array}{c} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}}$$

$$B_sY = \frac{\begin{array}{c} B_sy*G_sx*W_sy - B_sy*G_sy*W_sx - B_sy*G_sx*W_dy + \\ B_sy*G_sy*W_dx + B_sy*W_sx*W_dy - B_sy*W_sy*W_dx \end{array}}{\begin{array}{c} B_sx*G_sy*W_dy - B_sy*G_sx*W_dy - B_sx*W_sy*W_dy + \\ B_sy*W_sx*W_dy + G_sx*W_sy*W_dy - G_sy*W_sx*W_dy \end{array}},$$

wherein (Bsx, Bsy) are coordinates of the blue color coordinate point Bs, (Gsx, Gsy) are coordinates of the green color coordinate point Gs, (Wsx, Wsy)-are coordinates of the white color coordinate point, and (Wdx, Wdy) are coordinates of the standard white color coordinate point under the sRGB system.

3. A method of RGBW compensation based on a color aberration of a white subpixel, wherein color aberration exists between a color coordinate point Ws of the white subpixel of an image pixel on a RGBW panel defined in a RGBW color space and a standard white color coordinate point Wd in an sRGB system before compensating, the method comprising the following steps:

supplying first data of the image pixel defined in the RGBW color space, which includes color coordinates of each of a red subpixel, a blue subpixel, a green subpixel, and a white subpixel of the image pixel on the RGBW panel and respectively define a red color coordinate point Rs, a blue color coordinate point Bs, a green color coordinate point Gs, and the white color coordinate point Ws in the RGBW color space;

processing the color coordinates of the red, blue, green, and while subpixels of the image pixel on the RGBW panel to define a triangle RsGsBs with vertices being defined by the color coordinate points Rs, Gs, and Bs of the red subpixel, the green subpixel and the green pixel of the image pixel, the triangle being divided into three triangular regions, which are respectively defined as a first triangular region RsGsWs, a second triangular region GsBsWs, and a third triangular region BsRsWs, having vertices respectively defined by the red, green, and white color coordinate points Rs, Gs, Ws, the green, blue, and white color coordinate points Gs, Bs, Ws, and the blue, red, and while color coordinate points Bs, Rs, Ws, with the white color coordinate point Ws as a center point;

determining one of the three triangular regions, RsGsWs, GsBsWs, and BsRsWs, where the standard color coordinate point Wd is located, wherein the three vertices of the one of the three triangular regions include the center point Ws and two outer points, which are two of the red, green, and blue color coordinate points Rs, Gs, Bs;

compensating the white subpixel by applying a predetermined normalized proportion operation to the first data of the color coordinates corresponding to the two outer points of the one of the three triangular regions in order to correct the first data to form second data of the image pixel;

outputting the second data of the image pixel based on the RGBW color space;

wherein the predetermined normalized proportion operation is carried out as follows:

when the one of the three triangular regions in which the standard white color coordinate point Wd is located is the triangular region BsRsWs, calculating a normalized proportion of luminance among the blue subpixel, red subpixel and white subpixel as BsY, RsY, WsY, wherein BsY+RsY+WsY=1;

applying the normalized proportion BsY, RsY, WsY to correct the first data to obtain the second data of the image pixel based on the RGBW color space, where $$Rfo(j)=Ro(j)+Wo(j)*RsY(j),$$

$$Gfo(j)=Go(j),$$

$$Bfo(j)=Bo(j)+Wo(j)*BsY(j), \text{ and}$$

$$Wfo(j)=Wo(j)*WsY(j),$$

wherein Ro(j), Go(j), Bo(j), and Wo(j) are the first data of a pixel point j, Rfo(j), Gfo(j), Bfo(j), and Wfo(j) are the second data of the pixel point j, BsY(j), GsY(j), and WsY(j) represent the normalized proportion of luminance among the blue subpixel, the red subpixel and the white subpixel of the pixel point j.

4. The method according to claim 3, wherein the normalized proportion of luminance among the blue subpixel, red subpixel and white subpixel, BsY, RsY, WsY, is obtained according to the following formula:

$$W_sY = \frac{\begin{array}{l} B_sx*R_sy*W_sy - B_sy*R_sx*W_sy - B_sx*W_sy*W_dy + \\ B_sy*W_sy*W_dx + R_sx*W_sy*W_dy - R_sy*W_sy*W_dx \end{array}}{\begin{array}{l} B_sx*R_sy*W_dy - B_sy*R_sx*W_dy - B_sx*W_sy*W_dy + \\ B_sy*W_sx*W_dy + G_sx*W_sy*W_dy - R_sy*W_sx*W_dy \end{array}}$$

$$R_sY = \frac{\begin{array}{l} B_sx*R_sy*W_sy - B_sy*R_sy*W_sx - B_sx*R_sy*W_dy + \\ B_sy*R_sy*W_dx + R_sy*W_sx*W_dy - R_sy*W_sy*W_dx \end{array}}{\begin{array}{l} B_sx*R_sy*W_dy - B_sy*R_sx*W_dy - B_sx*W_sy*W_dy + \\ B_sy*W_sx*W_dy + R_sx*W_sy*W_dy - R_sy*W_sx*W_dy \end{array}}$$

$$B_sY = \frac{\begin{array}{l} B_sy*R_sx*W_sy - B_sy*R_sy*W_sx - B_sy*R_sx*W_dy + \\ B_sy*R_sy*W_dx + B_sy*W_sx*W_dy - B_sy*W_sy*W_dx \end{array}}{\begin{array}{l} B_sx*R_sy*W_dy - B_sy*R_sx*W_dy - B_sx*W_sy*W_dy + \\ B_sy*W_sx*W_dy + R_sx*W_sy*W_dy - R_sy*W_sx*W_dy \end{array}},$$

wherein (Bsx, Bsy) are coordinates of the blue color coordinate point Bs, (Rsx, Rsy) are coordinates of the red color coordinate point Rs, (Wsx, Wsy) are coordinates of the white color coordinate point, and (Wdx, Wdy) are coordinates of the standard white color coordinate point under the sRGB system.

5. A method of RGBW compensation based on a color aberration of a white subpixel, wherein color aberration exists between a color coordinate point Ws of the white subpixel of an image pixel on a RGBW panel defined in a RGBW color space and a standard white color coordinate point Wd in an sRGB system before compensating, the method comprising the following steps:

supplying first data of the image pixel defined in the RGBW color space, which includes color coordinates of each of a red subpixel, a blue subpixel, a green subpixel, and a white subpixel of the image pixel on the RGBW panel and respectively define a red color coordinate point Rs, a blue color coordinate point Bs, a green color coordinate point Gs, and the white color coordinate point Ws in the RGBW color space;

processing the color coordinates of the red, blue, green, and while subpixels of the image pixel on the RGBW panel to define a triangle RsGsBs with vertices being defined by the color coordinate points Rs, Gs, and Bs of the red subpixel, the green subpixel and the green pixel of the image pixel, the triangle being divided into three triangular regions, which are respectively defined as a first triangular region RsGsWs, a second triangular region GsBsWs, and a third triangular region BsRsWs, having vertices respectively defined by the red, green, and white color coordinate points Rs, Gs, Ws, the green, blue, and white color coordinate points Gs, Bs, Ws, and the blue, red, and while color coordinate points Bs, Rs, Ws, with the white color coordinate point Ws as a center point;

determining one of the three triangular regions, RsGsWs, GsBsWs, and BsRsWs, where the standard color coordinate point Wd is located, wherein the three vertices of the one of the three triangular regions include the center point Ws and two outer points, which are two of the red, green, and blue color coordinate points Rs, Gs, Bs;

compensating the white subpixel by applying a predetermined normalized proportion operation to the first data of the color coordinates corresponding to the two outer points of the one of the three triangular regions in order to correct the first data to form second data of the image pixel;

outputting the second data of the image pixel based on the RGBW color space;

wherein the predetermined normalized proportion operation is carried out as follows:

when the one of the three triangular regions in which the standard white color coordinate point Wd is located is the triangular region RsGsWs, calculating a normalized proportion of luminance among the red subpixel, green subpixel and white subpixel as RsY, GsY, WsY, wherein RsY+GsY+WsY=1;

applying the normalized proportion RsY, GsY, WsY to correct the first data to obtain the second data of the image pixel based on the RGBW color space, where $$Rfo(k)=Ro(k)+Wo(k)*RsY(k),$$

$$Gfo(k)=Go(k)+Wo(k)*GsY(k),$$

$$Bfo(k)=Bo(k), \text{ and}$$

$$Wfo(k)=Wo(k)*WsY(k),$$

wherein Ro(k), Go(k), Bo(k), and Wo(k) are the first data of a pixel point k, Rfo(k), Gfo(k), Bfo(k), and Wfo(k) are the second data of the pixel point k, RsY(k), GsY(k), and WsY(k) represent the normalized proportion of luminance among the red subpixel, the green subpixel and the white subpixel of the pixel point k.

6. The method according to claim 5, wherein the normalized proportion of luminance among the red subpixel, green subpixel and white subpixel, RsY, GsY, WsY, is obtained according to the following formula:

$$W_sY = \frac{R_sx*G_sy*W_sy - R_sy*G_sx*W_sy - R_sx*W_sy*W_dy + R_sy*W_sy*W_dx + G_sx*W_sy*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$G_sY = \frac{R_sx*G_sy*W_sy - R_sy*G_sy*W_sx - R_sx*G_sy*W_dy + R_sy*G_sy*W_dx + G_sx*W_sx*W_dy - G_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy}$$

$$R_sY = \frac{R_sy*G_sx*W_sy - R_sy*G_sy*W_sx - R_sy*G_sy*W_dy + R_sy*G_sy*W_dx + R_sy*W_sx*W_dy - R_sy*W_sy*W_dx}{R_sx*G_sy*W_dy - R_sy*G_sx*W_dy - R_sx*W_sy*W_dy + R_sy*W_sx*W_dy + G_sx*W_sy*W_dy - G_sy*W_sx*W_dy},$$

wherein (Rsx, Rsy) are coordinates of the red color coordinate point Rs, (Gsx, Gsy) are coordinates of the green color coordinate point Gs, (Wsx, Wsy) are coordinates of the white color coordinate point, and (Wdx, Wdy) are coordinates of the standard white color coordinate point under the sRGB system.

* * * * *